United States Patent [19]

Osthus

[11] 4,343,449

[45] Aug. 10, 1982

[54] PORTABLE SIGN

[75] Inventor: Ramon L. Osthus, Clear Lake, Iowa

[73] Assignee: Triad Service & Marketing, Ltd., Marshalltown, Iowa

[21] Appl. No.: 152,147

[22] Filed: May 21, 1980

Related U.S. Application Data

[63] Continuation-in-part of Ser. No. 62,155, Jul. 26, 1979, abandoned.

[51] Int. Cl.[3] ..... A45F 3/44; A16M 13/00

[52] U.S. Cl. ..... 248/156; 248/121; 248/530

[58] Field of Search ..... 248/530, 532, 533, 156, 248/545, 121, 122; 40/607, 606

[56] References Cited

U.S. PATENT DOCUMENTS

| | | | |
|---|---|---|---|
| 1,002,260 | 9/1911 | Golden | 248/121 |
| 1,788,096 | 1/1931 | Friedmann | 248/159 X |
| 2,522,345 | 9/1950 | Cashiopp | 248/121 |
| 2,559,302 | 7/1951 | Louft | 40/607 |
| 2,607,398 | 8/1952 | Andrews | 248/156 |
| 2,926,442 | 3/1960 | Reimel | 40/607 X |
| 2,975,999 | 3/1961 | Bunch | 248/121 |
| 3,313,513 | 4/1967 | Howell | 248/121 X |
| 3,612,460 | 10/1971 | Smith | 40/607 X |
| 3,835,568 | 9/1974 | Whitfield | 248/545 X |

FOREIGN PATENT DOCUMENTS

| | | | |
|---|---|---|---|
| 362817 | 6/1962 | Switzerland | 248/156 |

*Primary Examiner*—J. Franklin Foss
*Attorney, Agent, or Firm*—Harvey B. Jacobson

[57] ABSTRACT

A sign post is supported by a separable base anchored in the ground by a pair of ground-piercing blades depending from a tubular ground contact element associated with the base. A base section of the post is secured to the tubular element closer to one of the blades. A stabilizer bar projects from the tubular element laterally of the post.

4 Claims, 5 Drawing Figures

SOLD
635-0225
62
52
53
50
10
56
60
48
58
42
44
32
12
2
2
18
22
16
20
40
24
28
26
31
29
30

32
4
34
37
20
35
24
40
38
29
36
31
4

34
35
18
24
26

32
12
28
18
36

36

32
18
20
34
22
3
3
38

PORTABLE SIGN

This application is a continuation-in-part of application Ser. No. 62,155, filed July 26, 1979, now abandoned.

BACKGROUND OF THE INVENTION

This invention relates to portable sign posts of the type having a separable base portion adapted to be anchored in the ground, and is an improvement over the device disclosed in my prior copending application cited above.

Sign post assemblies having base portions adapted to be inserted into the ground at a desired location are already well-known. Such post assemblies suffer from various disadvantages including a lack of stability and difficulties in achieving a firm and satisfactory anchoring of the post assembly. A rather bulky and massive structure was therefore believed to be necessary for satisfactory and stable support of a sign post of substantial height capable of withstanding lateral wind forces.

There is a particular need for a lightweight, portable sign post assembly capable of being readily assembled and firmly anchored in the ground without excessive force and without requiring the use of special and/or massive tools. Prior art sign post assemblies, as aforementioned, are unsuitable. It is therefore an important object of the present invention to provide a portable sign post assembly having the desirable attributes referred to and avoiding the disadvantages of the prior art arrangements.

A further object of the present invention is to provide a portable sign post assembly that is more rugged and adjustable to a less bulky and more compact form for transport purposes.

SUMMARY OF THE INVENTION

In accordance with the present invention, the base portion of a portable sign post assembly features an elongated tubular, ground contact element from which a pair of ground-piercing blades or spikes with opposed tapers depend at opposite longitudinal ends of the element. A post section extends from the tubular element at a location closer to one of the blades than the other in order to balance the offset loading of the upper portion of the sign assembly. Plugs aligned with the blades are welded within the tubular element adjacent opposite ends thereof. Secured to the underside of the tubular element is an elongated, stabilizer element in the form of an angle iron bar that is angularly adjustable between a transport position parallel to the tubular element and an anchoring position projecting laterally therefrom. The upper horizontal leg portion of the stabilizer bar is adapted to engage the ground laterally of the post in the anchoring position to provide lateral stability for the sign post assembly.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

DETAILED DESCRIPTION OF A SPECIFIC EMBODIMENT

Figure 1:
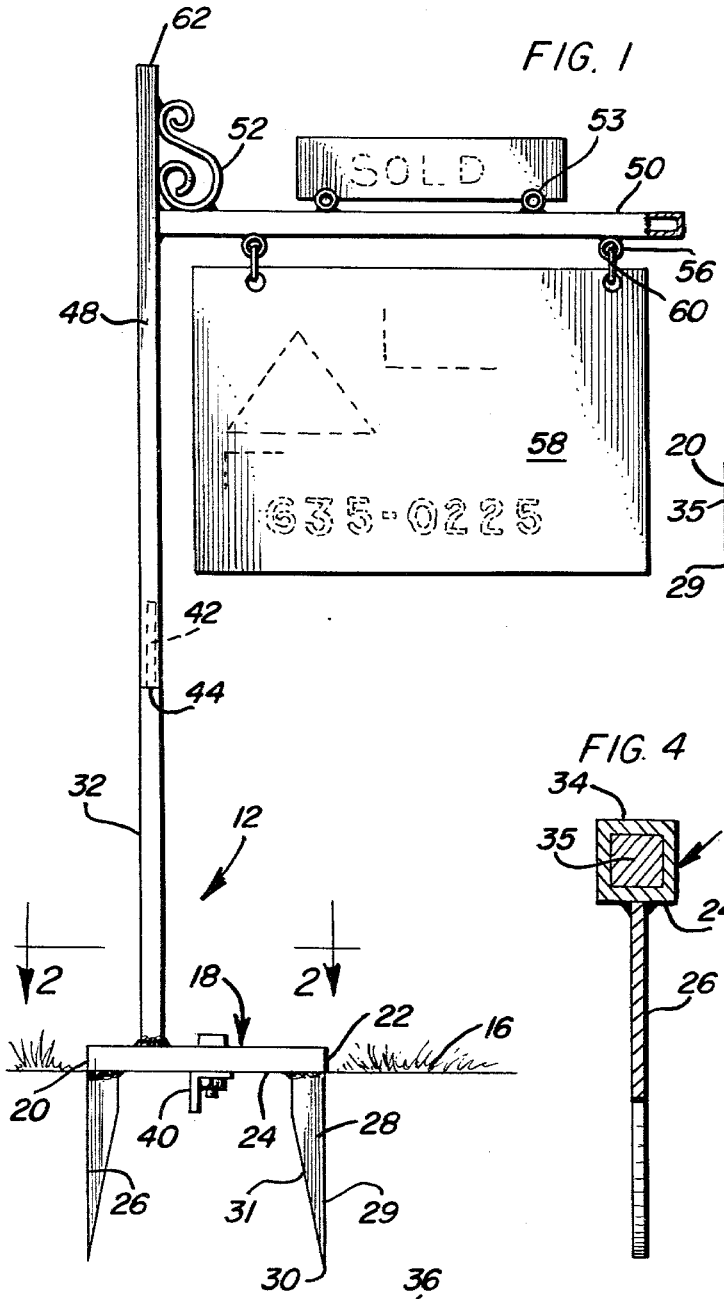
FIG. 1 is a side elevation view of a portable sign assembly constructed in accordance with the present invention.

Referring now to the drawings in detail, FIG. 1 illustrates a typical sign assembly generally referred to by reference numeral 10 constructed in accordance with the present invention. The assembly 10 includes a lower base section generally referred to by reference numeral 12 and an upper section generally referred to by reference numeral 14, the two sections being disassembled from each other so as to enable transport of the disassembled sections more readily, within the trunk of an automotive vehicle, for example. Prior to assembly of the sections 12 and 14, the base section 12 is firmly anchored in the ground 16 as shown in FIG. 1.

Figure 3:
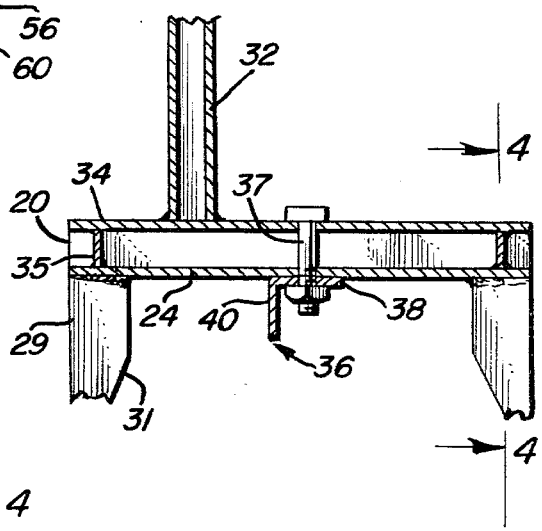
FIG. 3 is a section view taken substantially through a plane indicated by section line 3—3 in FIG. 2.
Figure 4:
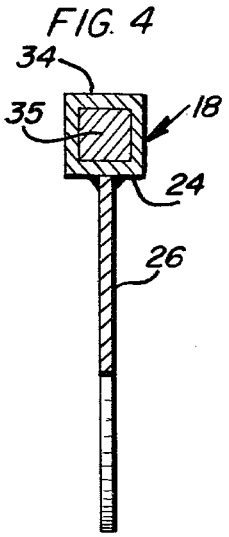
FIG. 4 is a section view taken substantially through a section indicated by section line 4—4 in FIG. 3.

The base section 12 includes an elongated tubular ground-contacting element 18 as more clearly seen in FIGS. 3 and 4. The element 18 may be substantially rectangular in cross section, as shown, having opposite longitudinal ends 20 and 22. Secured to and depending from the undersurface 24 of the element 18 are a pair of ground-piercing blades or spikes 26 and 28. The blades have outer vertical edges 29 that are parallel and confronting edges 31 that diverge so that the blades taper to points 30 as shown and are aligned with each other and with a base post section 32 secured to the top surface 34 of the element 18, as by welding. The ground-piercing blades 26 and 28 are secured to the element adjacent the opposite ends 20 and 22 while the post section 32 is secured thereto and projects therefrom in the opposite directional sense at a location closer to the blade 26 than the blade 28. As a result, the base 12 when anchored in the ground will offer greater resistance to a clockwise turning moment, as viewed in FIG. 1, produced by the offset loading of the upper section 14 of the sign assembly. Further, the tubular element is closed by plugs 35 welded therein adjacent the ends 20 and 22 and in alignment with the blades 26 and 28.

In order to provide lateral stability for the assembly 10, when anchored in the ground, an elongated stabilizer bar 36 is pivotally and adjustably secured to the undersurface 24 of the element 18 by a fastener bolt assembly 37 as shown in FIG. 3. The stabilizer bar is in the form of an angle iron having an upper horizontal leg surface 38 adapted to be flush with the ground 16 when the base section is anchored therein. A vertical leg portion 40 as shown in FIG. 1 will accordingly be embedded in the ground. In the anchoring position, the stabilizer bar 36 engages the ground laterally of the element 18 in a plane generally perpendicular to the ground-piercing blades and the post section.

The base post section 32 is preferably made of tubular material, the material being the same as the other parts of the base section, such as iron, steel or aluminum. The tubular post section 32 is non-circular in cross section and has a non-circular connector portion 42 of smaller cross-sectional dimension secured to and projecting from the upper end 44. The connector portion 42 is adapted to be received within a lower socket portion of a tubular post section 48 associated with the upper section 14 of the sign assembly to form a joint between post section 32 and 48. The upper post section 48 has the same tubular cross section as that of the lower post section 32 so as to form a flush assembly therewith.

As shown in FIG. 1, a horizontal bar 50 of the same tubular construction is secured as by welding to the upper post section. Suitable interconnecting brace structure 52 is provided between the horizontal bar 50 and the upper post section 48. Spaced eyelets 53 are provided on the upper edge of the horizontal bar 50 to which a sign panel 54 may be attached. The lower edge of the horizontal bar 50 is provided with suitably spaced eyelets 56 from which a relatively larger sign panel 58 is suspended by links 60. The horizontal bar 50 and the sign panels supported thereby establish the offset loading aforementioned. Although the overhang of the sign panels associated with the upper section 14 of the sign assembly is intended to be directionally aligned with the element 18 relative to the post sections 32 and 48, it will be apparent that the sign panels may be reoriented 90° therefrom by reassembly of the post sections 32 and 48 made possible by the square cross sections of the connector 42 and its socket. Such reorientation may be useful where the base section 12 is anchored on a sloping grade of the ground. In order to protect the tubular parts of the assembly, from internal corrosion, the post sections are provided with caps 62.

Figure 5:
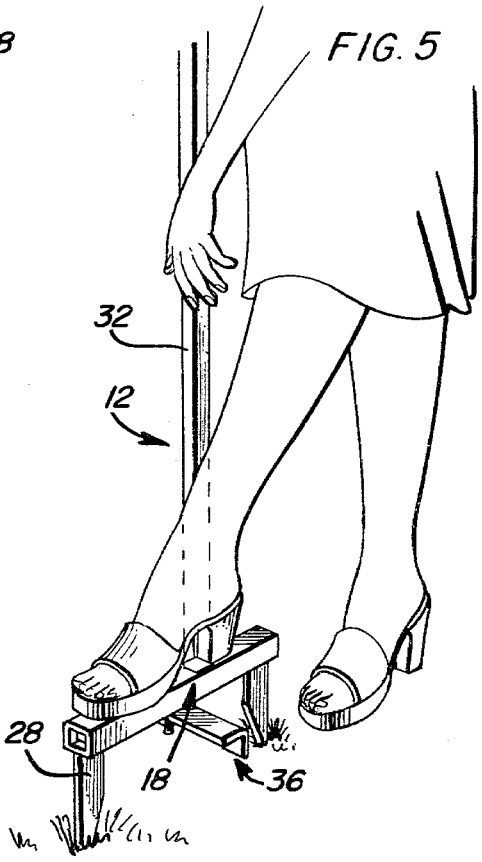
FIG. 5 is a partial perspective view illustrating the manner in which the base section of the sign assembly is anchored in the ground.
Figure 2:
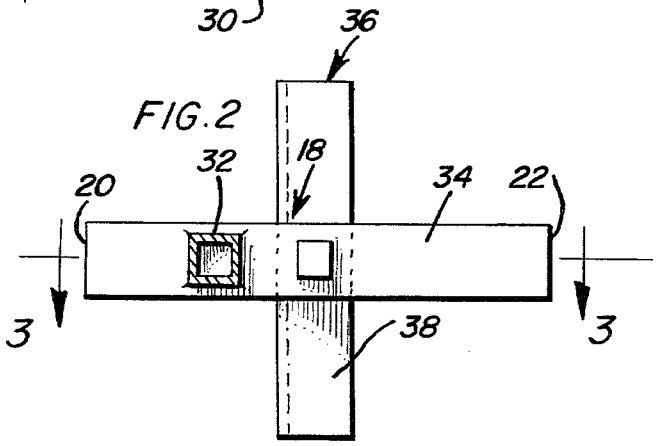
FIG. 2 is an enlarged partial section view taken substantially through a plane indicated by section line 2—2 in FIG. 1.

The sign assembly is anchored in the ground by applying vertical pressure to the base section 12 before assembly, causing the ground-piercing blades 28 and 26 to be inserted into the ground. Toward that end, a person's foot may be placed on the top surface 34 of the element 18 and the person's weight applied thereto as shown in FIG. 5 in order to anchor the base section in the ground. The element 18 is accordingly dimensioned to accommodate a human foot as shown. If the ground is too hard for such insertion of the blades, a mallet may be utilized to apply impact force to the element 18. The impact force so applied will be transmitted to the blades through the plugs 35. The base section will be firmly anchored when the lateral stabilizer bar 36 engages the ground on both sides of the element 18. The opposed taper of the blades 26 and 28 facilitates insertion into the ground as well as withdrawal from the ground while the tubular construction of the element 18 will resist bending under the impact forces applied. The base section may be withdrawn by use of a crowbar placed under the element or may be left in the ground until soil conditions permit easier withdrawal. When withdrawn, the section may be placed in a more compact form by loosening bolt assembly 37 and turning the stabilizer bar to its transport position parallel to the element 18. The stabilizer bar 36 is of such length to fit between the blades 26 and 28 in the transport position.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. For use with a portable post assembly having elongated post sections interconnected by a separable joint, a base adapted to be anchored in the ground by vertical pressure applied thereto, including an elongated ground contact element dimensioned between opposite ends to accommodate a human foot, ground-piercing means means depending from said element adjacent said opposite ends thereof for piercing the ground in response to the vertical pressure applied, one of said elongated post sections projecting from the element at a location closer to one of said opposite ends thereof, and stabilizer means secured to the element in spaced relation to the ground piercing means for engagement with the ground laterally of the element, said stabilizer means comprising an elongated member pivotally and adjustably attached to said element and having a ground level surface portion generally perpendicular to said one of the post sections and a depending leg adapted to be embedded in the ground, said ground-piercing means comprising a pair of blades with opposed tapers.

2. For use with a portable post assembly, a ground support base adapted to be anchored in the ground by vertical pressure applied thereto, including a ground contacting element having opposite ends and dimensioned to accommodate a human foot between said ends, spaced blades secured to the element in alignment with a vertical ground-piercing plane, a post section secured to the element in spaced relation to both of the blades and projecting from the element in a directional sense opposite to the blades, and stabilizer means projecting from the element for engagement with the ground.

3. The support base as defined in claim 2 wherein said element is tubular in shape, and plugs positioned within the element in alignment with said blades.

4. For use with a portable post assembly, a ground support base adapted to be anchored in the ground by vertical pressure applied thereto, including a ground contacting element dimensioned to accommodate a human foot, spaced blades secured to the element in alignment with a vertical ground-piercing plane, a post section secured to the element in spaced relation to the blades and projecting from the element in a directional sense opposite to the blades, and stabilizer means projecting from the element for engagement with the ground, said blades having substantially parallel outer edges and confronting edges that diverge from the element.

* * * * *